US005706672A

United States Patent [19]

Miyazaki

[11] Patent Number: 5,706,672

[45] Date of Patent: Jan. 13, 1998

[54] AIR CONDITIONER

[75] Inventor: Satoi Miyazaki, Kawasaki, Japan

[73] Assignee: Fujitsu General Limited, Kawasaki, Japan

[21] Appl. No.: 601,860

[22] Filed: Feb. 15, 1996

[30] Foreign Application Priority Data

Apr. 20, 1995 [JP] Japan ..... 7-095653

[51] Int. Cl.[6] ..... F24F 1/02

[52] U.S. Cl. ..... 62/427; 74/104; 403/329

[58] Field of Search ..... 62/404, 407, 427, 62/409, 262, 426, 408; 454/201, 202; 74/104; 403/326, 327, 329

[56] References Cited

U.S. PATENT DOCUMENTS

| | | | |
|---|---|---|---|
| 2,801,582 | 8/1957 | Kuhlenschmidt et al. | 454/202 |
| 2,832,943 | 4/1958 | Cutler | 403/326 |
| 3,228,254 | 1/1966 | Biesecker | 74/104 |
| 3,617,077 | 11/1971 | Cavanaugh | 403/329 |
| 3,841,110 | 10/1974 | Schuster et al. | 62/427 |

*Primary Examiner*—William Doerrler
*Attorney, Agent, or Firm*—Kanesaka & Takeuchi

[57] ABSTRACT

An air conditioner of the invention is formed of a main body in a box form with a partition panel for dividing indoor and outdoor heat converter rooms, a base holder situated in the main body under the opening, a damper supported on the base holder for covering an opening of the partition panel to be movable relative to the opening of the partition panel, a control part movably disposed on the base holder, and an elongated connection member for connecting the control part and the damper to move the damper by operating the control part. The connection member is made of a synthetic resin and includes at both ends connecting devices integrally formed therewith to be connected to the control part and the damper. Also, a holding device is integrally formed with the base holder. The holding device guides the connection member and includes a holding part with a substantially C-shaped cross section for holding the connection member therein. Therefore, the damper and the control part can be easily assembled together with the connection member through the holding device.

15 Claims, 15 Drawing Sheets

AIR CONDITIONER

BACKGROUND OF THE INVENTION

1. Field of the Invention

The present invention relates to an air conditioner, and to be more precise, relates to an air conditioner which contains an indoor unit and an outdoor unit within a main body formed to be a virtual box form as one body.

2. Description of Related Art

In an air conditioner 100 illustrated in FIG. 13, a front cover 102 is attached to a front of a main body 101 formed to be a virtual box form, so as to be attachable and detachable, and a grille 103 is formed on the side surface of the main body 101. In this air conditioner 100, indoor air is taken into the inside of the main body 101 through a suction port 104 provided at the front cover 102, and attempered air such as warm air, cool air, and so on which is attempered by conducting heat conversion with outdoor air is sent indoor through a blast port 105 provided at the front cover 102. When the above-described air conditioner 100 is installed, an insertion hole which communicates an indoor and an outdoor is formed, for example, on a wall of a building, and then the main body 101 is inserted into the insertion hole so that the front cover 102 faces the indoor side, and the grille 103 is exposed outdoor.

As FIG. 14 illustrates, within the main body 101, an indoor heat converter room 106 and an outdoor heat converter room 107 are formed by being divided by a partition panel 108 in order to conduct the heat conversion of the indoor air.

The indoor heat converter room 106 includes an indoor heat converter 109 positioned adjacent to the front cover 102, and an indoor fan 110 positioned more inward inside the main body 101 than the indoor heat converter 109. In this indoor heat converter room 106, when the indoor fan 110 starts to operate, the heat conversion of the indoor air is conducted by taking the indoor air in the inside of the main body 101 and passing the air through the indoor heat converter 109, and then sending the air indoor through the blast port 105 as attempered air after passing along a blast passage 111 formed by the partition panel 108.

Meanwhile, the outdoor heat converter room 107 includes an outdoor heat converter 112 for conducting the heat conversion for the indoor heat converter 109 with outdoor air and an outdoor fan 113 for sending the outdoor air to the outdoor heat converter 112, and the outdoor fan 113 is supported by the outdoor heat converter 112 with a support member 114 of a plate form between them. In this outdoor heat converter room 107, when the outdoor fan 113 starts to operate, the outdoor air is taken in the inside of the main body 101 from the grille 103. The heat conversion of the outdoor air taken in from the grille 103 is conducted, when air passes through the outdoor heat converter 112, by way of an introduction passage 115 formed by the partition plate 108 and the support member 114 and the outdoor fan 113, and then the air is discharged outdoor from the back of the main body 101.

On the partition panel 108, an opening 116 which communicates the blast passage 111 and the introduction passage 115 is provided. The opening 116 is provided so that a part of the attempered air sent along the blast passage 111 is discharged into the introduction passage 115 in order to suitably adjust the flow amount, the temperature, and so on of the attempered air, and can be opened and closed by a damper operating portion 200.

FIG. 15 illustrates one example of the damper operating portion 200. This damper operating portion 200 has a base holder 201 (refer to FIG. 13 and FIG. 14) incorporated in the main body 101, a damper 202 which, is supported by the base holder 201, is covering the opening 116, and is able to move in the direction apart from the opening 116, a control part 203 which is provided at the base holder 201 and can mechanically displace relative to the base holder 201, and a connection member 204 which is connected to the damper 202 and the control part 203, and moves the damper 202 by moving and following the displacement of the control part 203.

In the damper 202, a plate part 202C is connected to a pair of support parts 202A and 202A which are inserted into and fixed at the base holder 201 by hinge parts 202B and 202B. In this damper 202, the plate part 202C having a size larger than the opening 116 opens and closes the opening 116 by rotating around the hinge parts 202B and 202B at the support parts 202A and 202A.

In the control part 203, a lever 203A formed to be a virtually L-shaped form is fixed at the base holder 201 by a fixing screw 205 inserted through a bending part 203B so as to be able to rotate. The lever 203A is positioned so that a handle part 203C extending from the bending part 203B projects from a lever slit 201A formed in the base holder 201 and a displacement part 2030 which extends from the bending part 203B contained within the base holder 201.

A connection member 204 is made to be a wire 204B having an outer tube 204A. In this connection member 204, one end of the wire 204B is connected to a projection fragment 202D provided at the plate part 202C of the damper 202, and the other end of the wire 204 B is connected to the displacement part 203D of the lever 203A. In concrete, both ends of the wire 204B are respectively inserted through a fixing hole 202E formed at the projection fragment 202D, and a fixing hole 203E formed at the displacement part 203D, and are connected by a sleeve 204C so that both ends cannot be pulled out. This connection member 204 is fixed to the base holder 201 by mounting tools 204D which grip and hold a plurality of predetermined positions on the outer tube 204A, and screws 204E which are inserted through these mounting tools 204D and screwed into the base holder 201.

The damper operating portion 200 like this opens and closes the opening 116 provided on the partition panel 108 when the users of the air conditioner 100 move the handle part 203C of the control part 203 along the lever slit 201A.

However, the above-described damper operating portion 200 has the problems of high manufacturing cost of the air conditioner 100 as a result of the large number of required parts and the complicated assembly process, since the connection member 204 has the outer tube 204A and the wire 204B and a large number of the mounting tools 204D and screws 204E being required when the connection member 204 is fixed at the base holder 201.

Especially when the connection member 204 is connected to the damper 202 and the control part 203, beth ends of the wire 204B require to be carefully treated so that the wire 204B does not lose tension in its small parts, therefore the assembly process of the damper operating portion 200 is further complicated.

The present invention has been made to solve these conventional problems, and its object is to provide the air conditioner which reduces the manufacturing cost by reducing the number of parts included in the damper and by simplifying the assembly process.

SUMMARY OF THE INVENTION

In order to attain the above-described object, an invention according to a first aspect of the present invention is an air conditioner which is provided with a partition panel for dividing an indoor heat converter room from an outdoor heat converter room within a main body formed to be a virtual box form, and has a base holder which incorporates a damper operating portion for opening and closing an opening provided on the above-described partition panel in the above-described main body, a damper which covers the above-described opening, is supported by the above-described base holder and is able to move in the direction apart from the above-described opening, a control part which is provided at the above-described base holder and is able to mechanically displace the above-described base holder, and a connection member which is connected to the above-described damper and the above-described control part and moves the above-described damper by moving to follow the displacement of the above-described control part. The above-described connection member is connected to the above-described damper and the above-described control part by a connection means in which convex parts or pegs are inserted into concave parts, as well as guided by a holding means which is formed as a part of the above-described base holder, with the above-described convex portion of the above-described connection means projecting in the direction which crosses the direction in which the above-described damper moves and the direction in which the above-described holding part is displaced.

In this case, it is fine as a base holder if the base holder is formed in the same way as the base holder arranging the above-described damper operating portion is formed, and the form, dimensions, and so on may be appropriately set if the base holder can support the damper, provide the control part in it and can be incorporated in the main body. As a damper, like in the above-described damper operating portion, the damper which can rotate around the hinge may be used, or a damper like a shutter which opens and closes the opening by moving on the same surface as that of the partition panel may be used. Further, as a control part, mechanism such as for example, a slide lever, a knob of a push/pull operation, a button of a push/push cancel operation, a handle of a ring form or a crank form for rotating a predetermined rotation shaft, and so on, may be used, and it is fine if at least one part can mechanically displace the base holder to the predetermined position by moving, rotating and so on. As a connection member, a wire, rod, plate material, and so on may be used, and the connection member may be made of synthetic resin, metal, and wood formed in an appropriate form, with the existence of elasticity being optional. When, for example, a wire with elasticity is used as the connection member, it may be fine if one end of the wire is positioned along in the direction the damper moves, and the other end of the wire is positioned along in the direction in which the control part is displaced.

Meanwhile, as a holding means, for example, the arrangement where a holding part corresponding to the sectional form of the connection member is formed successively along the surface of the base holder may be adopted, or the arrangement where a large number of hooks of reverse J-shaped forms are formed along the base holder at predetermined intervals, or the arrangement where a hollow part through which the connection member can be inserted is formed at a thick portion of the base holder, and so on may be adopted. When the holding part is formed along the surface of the base holder as a holding means, the holding part may be formed by engraving the base holder so that the connection member does not project from the surface of the base holder, or the holding part may project in the direction apart from the base holder.

As a connection means, the convex parts or pegs may be formed to be column forms, square pillar forms, hook forms, and so on, and the concave parts or slots may be formed to be hole forms, opening forms, recess forms, and groove forms, and a mutual fixation of the convex parts and the concave parts is optional. When these convex parts or the concave parts are provided at the damper, the control part, and the connection member, the convex parts or the concave parts may be formed at the predetermined positions, or the convex parts or the concave parts which are separately formed may be fixed at predetermined positions by an appropriate means.

In the invention according to the first aspect of the present invention, wherein the connection member is guided by the holding means, the parts for fixing the connection member at the base holder as required in the prior art are not required, so that the number of the parts arranging the damper operating portion is reduced, and the assembly process of the damper operating portion is simplified. When the holding means has, for example, the holding part which continues along the base holder, it does not require to be doubly arranged by the wire and outer tube like the conventional connection member since the connection member is protected by the holding part, so that the number of the parts arranging the damper operating portion can be further reduced.

In the invention according to the first aspect, wherein the convex parts project in the direction which crosses the direction in which the damper moves and the direction in which the control part is displaced, the state that the convex parts are inserted into the concave parts is always maintained, regardless of the movement of the damper and the displacement of the control part, even when the convex parts and the concave parts are not mutually fixed. That is to say, in the invention according to the first aspect, wherein the connection of the connecting member to the damper and the control part is completed only by conducting a simple operation to insert the convex parts into the concave parts, the assembly process of the damper operating portion is greatly simplified, compared to the prior art, so that the above-described objects are attained.

In an invention according to a second aspect, the above-described convex part or peg is virtually cylindrical form, and the above-described concave part or slot has a pair of parallel sliding contact surfaces which hold the above-described convex part in the direction of the diameter. In this case, it is fine, as a concave part, if the groove where the convex part can slide is formed, or if a virtually U-shaped member into which the convex portion is inserted is separately provided. In this invention according to the second aspect, wherein a circumference surface of the convex portion linearly slides and contacts a pair of sliding contact surfaces, the state that the convex portion is inserted into the concave parts and a fixed sliding contact resistance is maintained since the convex part moves along the concave part, even when a relative position or a relative angle of the convex part and the concave part changes, following the movement of the damper or the displacement of the control part.

Further, in an invention according to a third aspect, wherein one of the above-described convex part and the above-described concave part is formed art he above-described connection member as a part of it, and the other of the above-described convex part and the above-described concave part is formed at the above-described damper and the above-described control part as a part of it, so that the convex part and the concave part are not required to be prepared as separate members, and the number of the parts arranging the damper operating portion can be further reduced.

Meanwhile, in an invention according to a fourth aspect, wherein the above-described connection member is made of synthetic resin, a desired form can be easily obtained, compared to the connection member made of, for example, metal and wood. When a synthetic resin material is appropriately selected for this connection member, the connection member can obtain excellent flexibility and make the friction coefficient of the surface small, so that the damper is surely moved by following the displacement of the control part, even when the connection member is bent by a holding means based upon, for example, the relative position of the damper and the control part.

In an invention according to a fifth aspect, wherein the sectional form which vertically crosses the longitudinal direction of the above-described connection member is a rectangular form, the sectional form may be formed to be, for example, a square, a rectangular, an L-shaped form, a T-shaped form, an H-shaped form and so on. In the invention according to the fifth aspect, wherein the sectional form which vertically crosses the longitudinal direction of the connection member is a rectangular form, comparably much strength can be obtained against a bending stress and a distortion stress.

Further, in an invention according to a sixth aspect, the above-described member is positioned along a plurality of surfaces which are connected at predetermined angles, and recess parts on the surface are formed at the position crossing the connection line of each of the above-described surfaces. In this case, it is fine, if the recess parts are formed by making the sectional form vertically crossing the longitudinal direction of the connection member small and narrow, or by bending the predetermined value of the connection member in a virtual crank form. In the invention according to the sixth aspect, wherein the positions crossing the connection lines are easily bent to the predetermined angles, the connection member is surely positioned along each surface without lifting from the base holder.

In an invention according to a seventh aspect, the above-described recess parts are formed by making the section area vertically crossing the longitudinal direction of the above-described connection member small and narrow. In this case, at the position where the recess parts are formed, the connection member may have the sectional form as in the sectional forms at the other positions, or may have a sectional form different from the sectional forms at the other positions. In the invention according to the seventh aspect, the mechanical strength at the positions where recess parts in the connection member are formed is more declined than at the other positions, and therefore the above-described positions are bent more easily.

In an invention according to an eighth aspect, wherein the above-described recess parts are formed to face the above-described connection line, the connection member and the connection line do not contact each other, and therefore there is less fear that the connection member will lift from the base holder.

In an invention according to a ninth aspect, wherein the above-described holding means is provided so as to project in the direction apart from the above-described base holder, the holding means can be provided regardless of the thickness of the base holder.

In an invention according to a tenth aspect, wherein the above-described holding means has the holding part of a virtually C-shaped cross section, the connection member can be easily attached to and detached from the holding means, so that the assembly process of the damper operating portion can be further simplified.

Further, in an invention according to an eleventh aspect, the above-described holding part is positioned with a sectional opening facing the direction apart from the above-described base holder, and workers can easily see and recognize a mutual state of the connection member and the holding means, so that there is less possibility of an inferior assembly and so on being conducted.

In an invention according to a twelfth aspect, the above-described holding part continues for a predetermined length along the above-described connection member. In this case, the holding part may be consecutively formed so that there is no end between the damper and the control part, or a plurality of holding parts may be formed at predetermined intervals. In this invention according to the twelfth aspect, wherein the holding means surely holds the connection member, there is less possibility of the connection member deviating from the holding part along with the displacement of the control part, even when, for example, the movement resistance of the damper is large, so that there is less possibility of the opening not opening or closing.

In an invention according to a thirteenth aspect, catch portions for holding the above-described connection member within the above-described holding means are provided at the sectional opening of the above-described holding part. In this case, the arrangement where a pair of projections facing each other is provided at the sectional opening of the holding part formed to be a virtually C-shaped section and so on may be adopted as the catch portions, and it is fine if the dimension of the interval between the projections is set a little smaller than the sectional width dimension of the connection member. In the invention according to the thirteenth aspect, wherein the connection member is held within the holding part by the catch portions, there is far less possibility of the connection member deviating from the holding part.

Further, in an invention according to a fourteenth aspect, the above-described holding part is formed along a plurality of planes connected at predetermined angles, and each of the above-described catch portions is provided at a connection line position of the above-described planes. In the invention according to the fourteenth aspect, wherein the catch portions are provided at the connection line positions, the connection member positioned along each plane does not lift from the base holder, so that the connection member can be surely positioned along each plane.

In an invention according to a fifteenth aspect, slits are formed at the position where the slits hold the above-described catch portions along in the direction in which the above-described holding part continuously stretches, and it is fine if one part of the holding part supporting the catch portions is made to deform, with being separate from the other parts, when the connection member is positioned within the holding part. In the invention according to the fifteenth aspect, wherein one part of the holding part supporting the catch portions can deform, with being separate from the other parts, the deformation stress generated by one part of the holding part does not have an effect on the other parts of the holding part, when the connection member is positioned within the holding part, so that there is less possibility that plasticity, damage, and so on are caused to the entire body of the holding part.

Meanwhile, in an invention according to a sixteenth aspect, wherein the above-described damper has a support part fixed at the above-described base holder, and a plate part connected to the above-described support part, and the above-described plate part can rotate at the above-described support part with a hinge part between them. In this case, it is fine as the damper, if the plate part can cover the opening, and the form, dimensions, and so on may be appropriately selected. In the invention according to the sixteenth aspect, the damper is arranged in a simple arrangement where the support part and the plate part are connected by the hinge, so that the manufacturing cost is comparatively low, and the damper can be widely used for openings with different forms and dimensions, by appropriately selecting and adopting the plate parts with different forms end dimensions.

In an invention according to a seventeenth aspect, wherein the above-described hinge part is a hinge which is made thin and formed to be a part of the above-described support part and the above-described plate part, a hinge member prepared separately is not required, so that the number of the parts arranging the damper operating portion can be further reduced.

Further, in an invention according to an eighteenth aspect, wherein the above-described damper is supported by a fixing means which presses engagement parts of a virtually sagittal form into mounting holes, and one pair of the above-described engagement parts is formed to be a part of the above-described support part, while the other pair of the above-described mounting holes is formed to be a part of the above-described base holder, it may be fine, if the damper is made of, for example, synthetic resin and so on. In the invention according to the eighteenth aspect, the damper is supported at the base holder by simply pressing the engagement parts of the virtually sagittal form into the mounting holes, so that the assembly process of the damper operating portion can be further simplified, compared to the work of, for example fixing with bolts and so on.

Meanwhile, in an invention according to a nineteenth aspect, wherein the above-described control part is a slide lever, the arrangement can be simplified, and made compact, compared to, for example, a knob of a push/pull operation, a button of a push/push cancel operation, a handle for rotating a rotation shaft, and so on. Accordingly, in the invention according to the nineteenth aspect, the number of the parts arranging the damper operating portion can be reduced, and the damper operating portion can be made compact.

In an invention according to a twentieth aspect, the above-described control part has a main body of the lever positioned along the outer surface of the above-described base holder, and an insertion fragment of the virtually sagittal form which is connected to the above-described main body of the lever, and is inserted through the inner surface side of the above-described base holder. In the invention according to the twentieth aspect, when the insertion fragment is pressed into the insertion hole which has been previously formed, corresponding to the form of the insertion fragment, at the predetermined position of the base holder, the insertion fragment of the virtually sagittal form is engaged in the inner surface of the base holder, and the insertion fragment cannot be pulled out of the insertion hole. Accordingly, in the invention according to the twentieth aspect, for example, a fixing screw and so on are not required, and the assembly of the control part is completed by only the extremely simple work of pressing the insertion fragment into the insertion hole, so that the number of the parts arranging the damper operating portion can be reduced, and the assembly process of the damper operating portion can be further simplified.

DETAILED DESCRIPTION OF THE PREFERRED EMBODIMENT(S)

Figure 1:
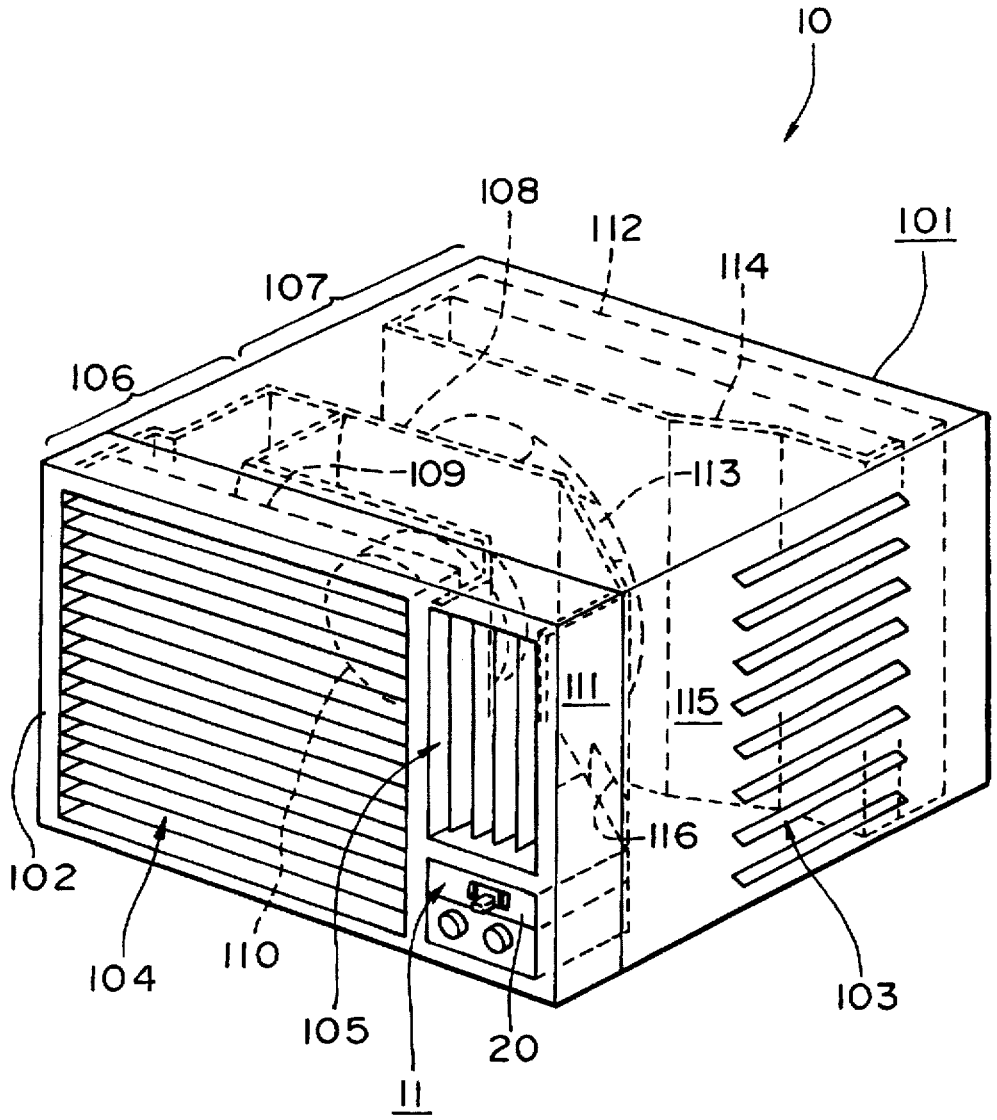
FIG. 1 is a general perspective view illustrating one embodiment of the present invention.
Figure 13:
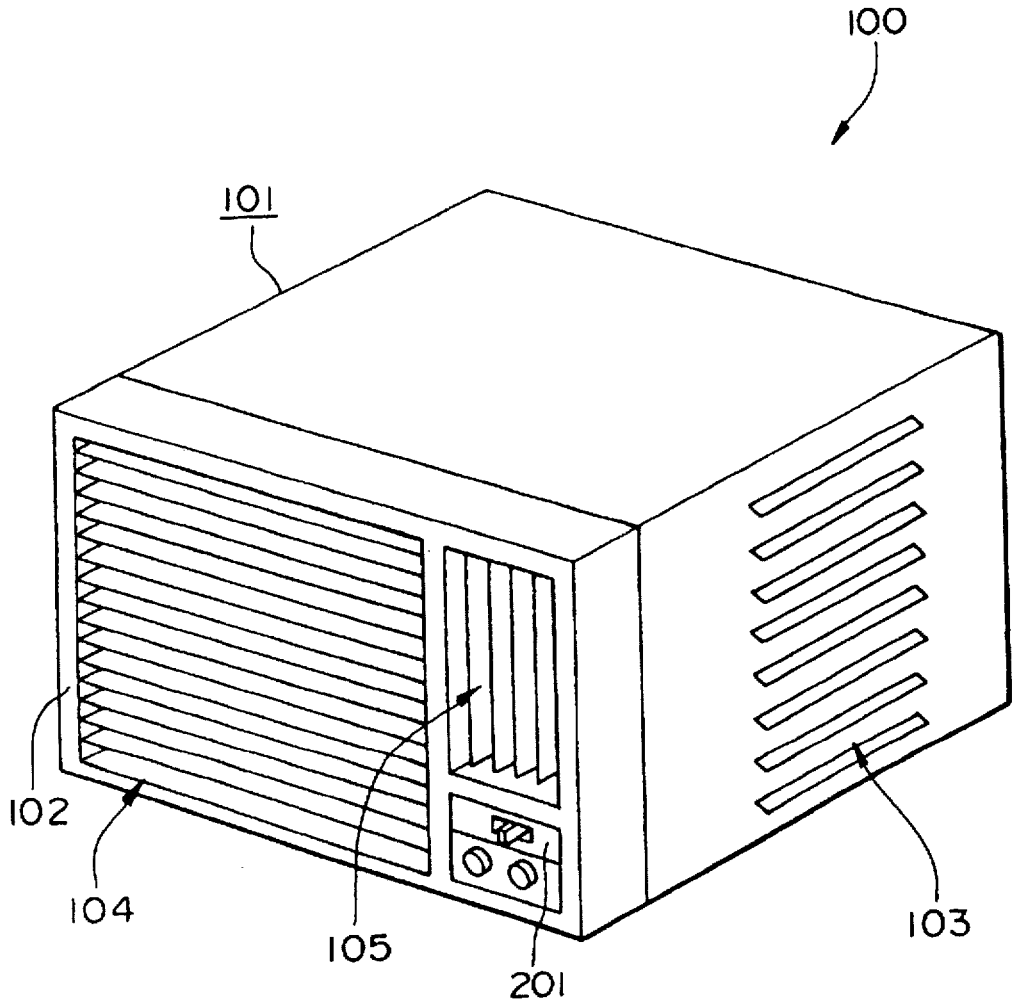
FIG. 13 Prior Art
FIG. 13 is a general perspective view illustrating an external appearance of an air conditioner.
Figure 14:
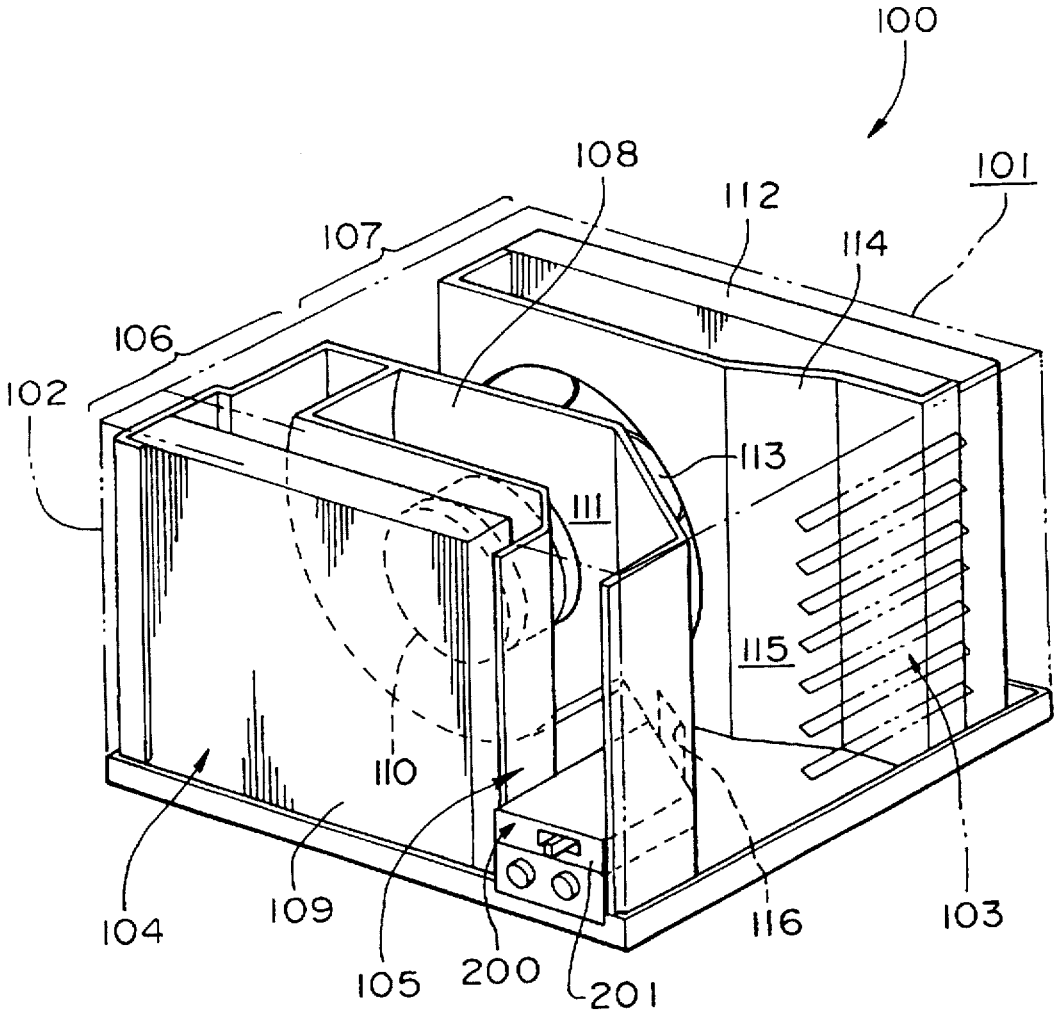
FIG. 14 Prior Art
FIG. 14 is a general perspective view illustrating an arrangement of the inside of the air conditioner.
Figure 15:
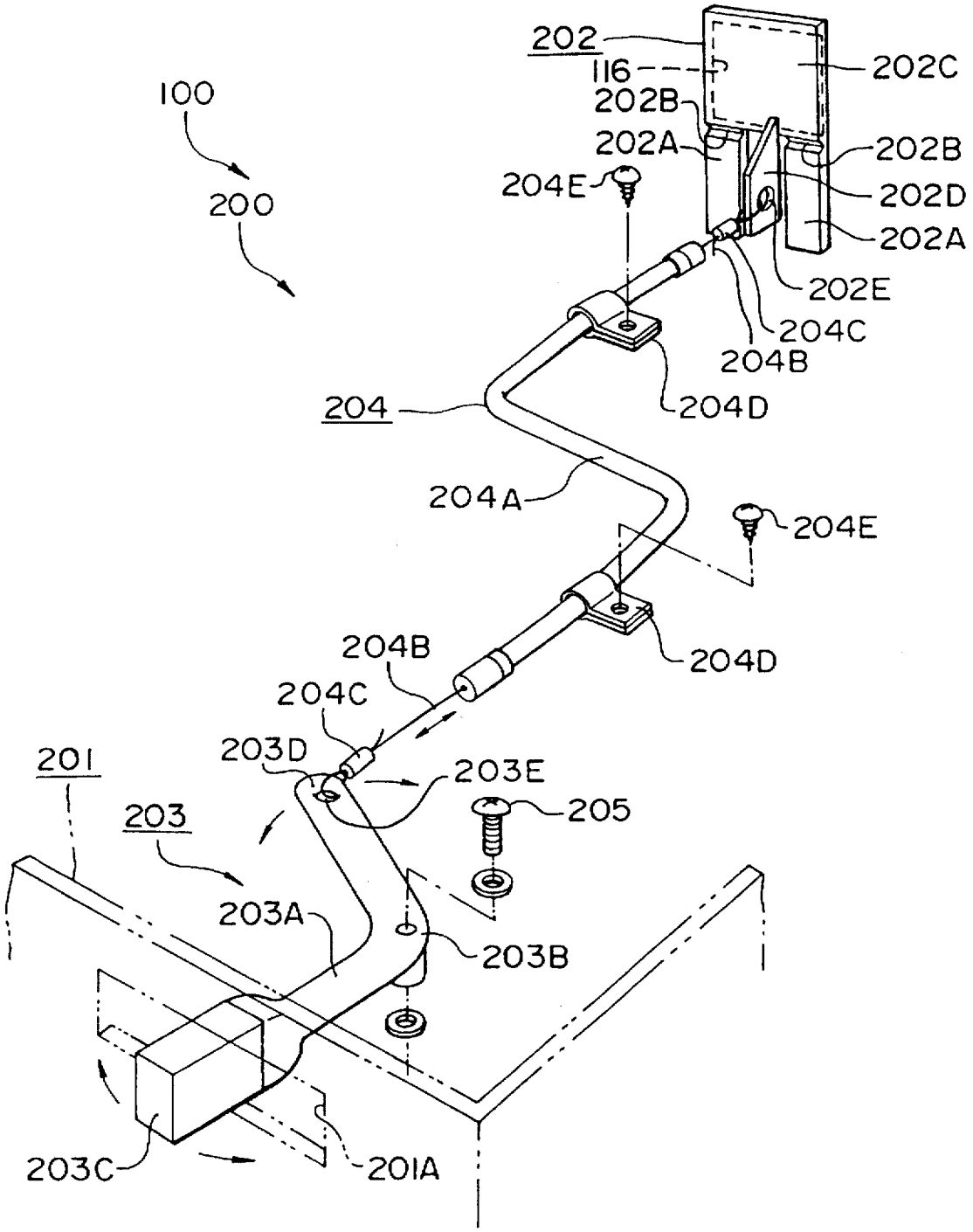
FIG. 15 Prior Art
FIG. 15 is a typical perspective view illustrating a damper operating portion applied for the conventional air conditioner.

The advantages of these inventions are well understood by reading the preferable embodiments described below with reference to the drawings. It is mentioned that, in the preferable embodiments described below, the description about the members which have been already described in FIG. 13, and FIG. 15 is shortened, or abbreviated by affixing identical marks in the drawings. FIG. 1 illustrates a preferable embodiment relating to the present invention. An air conditioner 10 in the present embodiment, wherein an indoor heat converter room 106 and an outdoor heat converter room 107 are formed by being divided by a partition panel 108 within a main body 101, is installed, after an insertion hole for communicating the indoor and outdoor has been previously formed on a wall surface of, for example, a building, so that a front cover faces the indoor side, and a grille 103 is exposed outdoor. In the air conditioner 10, an opening 116 provided on the partition panel 108 can be opened and closed by a damper operating portion 11.

Figure 2:
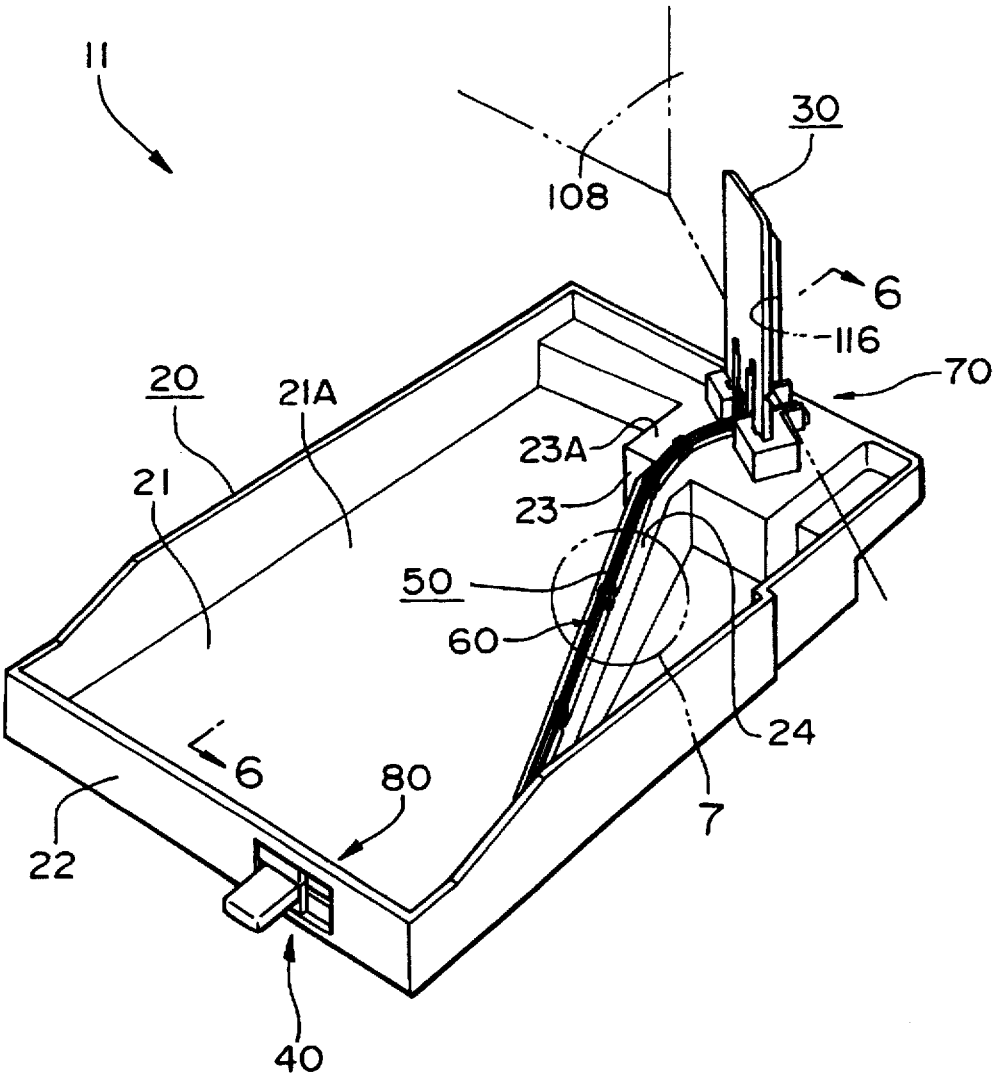
FIG. 2 is a general perspective view illustrating a damper operating portion.

As FIG. 2 illustrates, the damper operating portion 11 includes a vase holder 20 (refer to FIG. 1) incorporated in the main body 101, a damper 30 which can move in the direction apart from the opening 116, and covers the opening 116 which is supported by the base holder 20, a control part 40 which is provided at the base holder 20 and is able to mechanically displace relative to the base holder 20, and a connection member 50 which is connected to the damper 30 and the control part 40 for moving the damper 30 by moving the control part 40.

In the damper operating portion 11 of the present embodiment, guided by a holding means 60 formed to be a part of the base holder 20 is the connection member 50, which is connected to the damper 30 by a connection means 70, and the connection member 50 is connected to the control part 40 by a connection means 80.

The base holder 20 includes a main body of the base holder 21 of a virtually flat board form, and a wall portion 22 which is vertically provided at a side portion of the main body of the base holder 21 in the direction of the thickness of the main body of the base holder 21. The damper 30 is supported by a support stand 23 provided at the main body of the base holder 21, and the control part 40 is provided at the wall portion 22. A top surface 23A of the support stand 23 is more apart from a surface 21A than an upper end edge of the wall portion 22. Accordingly, a difference of elevation exists in the direction of the thickness of the main body of the base holder 21 between the position where the damper 30 is supported and the position where the control part 40 is provided.

Figure 3:
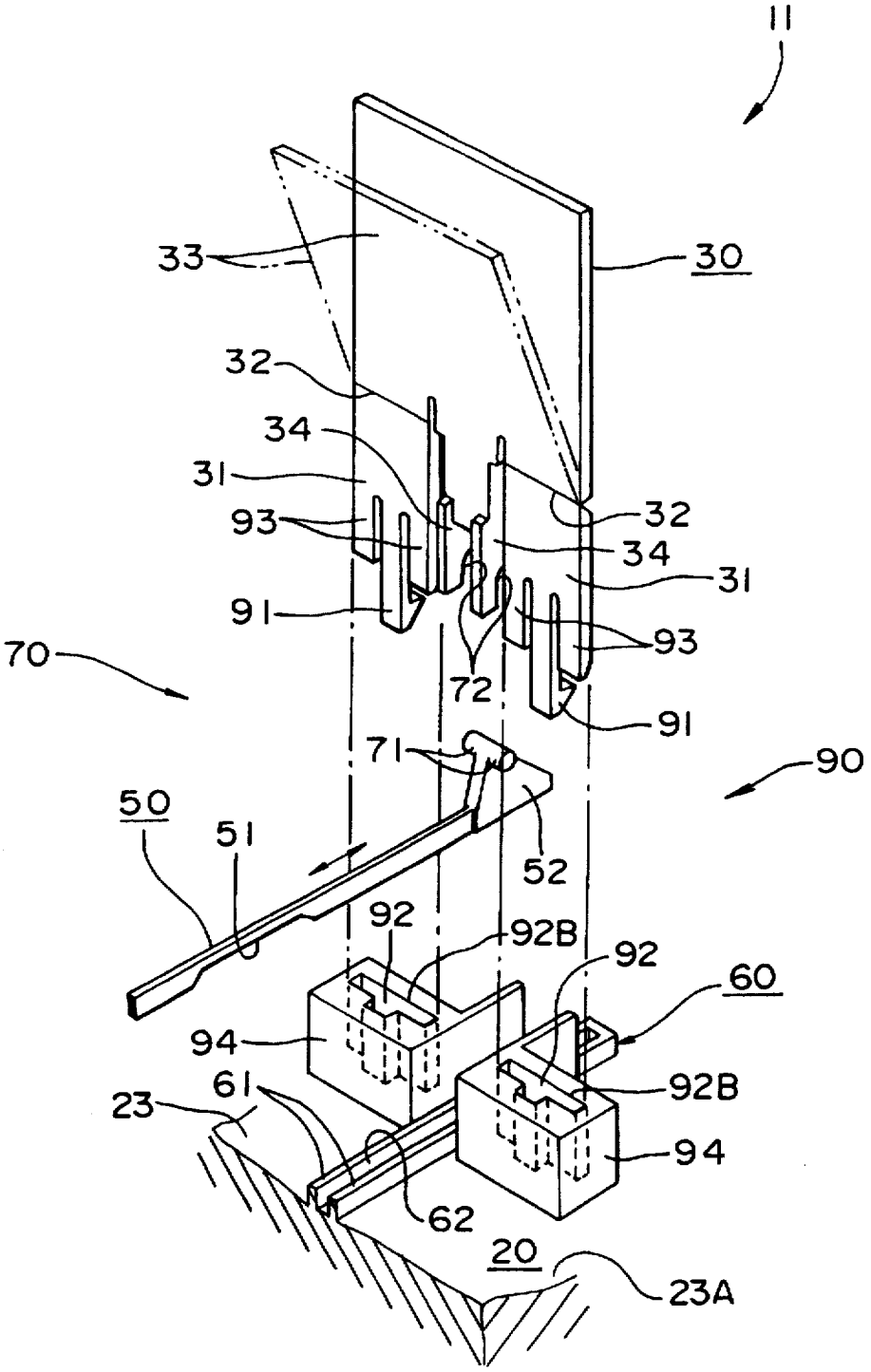
FIG. 3, and FIG. 4 are general perspective views illustrating a damper.
Figure 4:
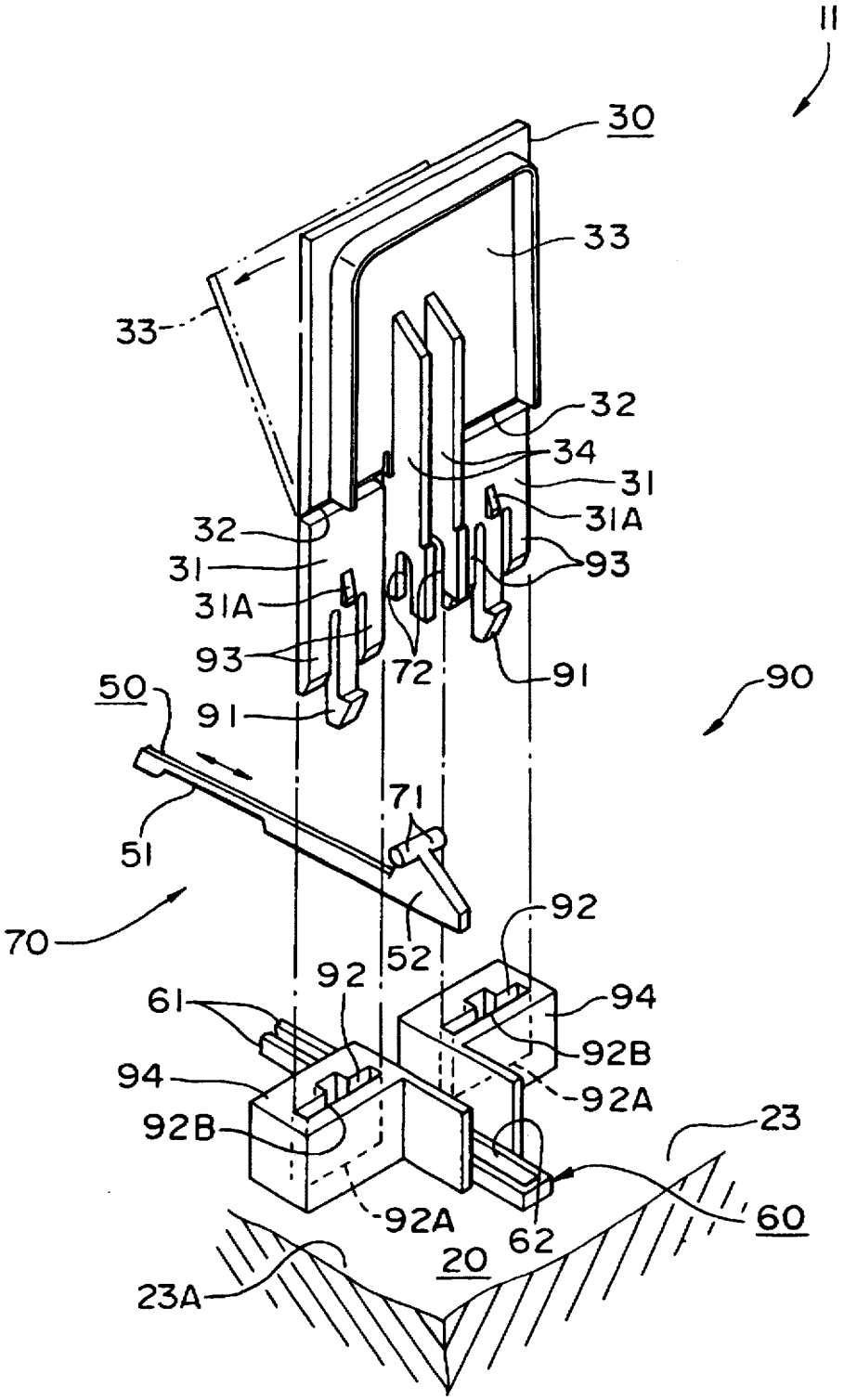

As FIG. 3 and FIG. 4 illustrate, the damper 30 includes a pair of support parts 31, and 31, and a plate part 33 which is connected to these support parts 31 and 31 by hinge parts 32, and 32, and the damper 30 is supported at the support stand 23 of the base holder 20 by a fixing means 90. The support parts 31, and 31 are virtual plate forms which are respectively positioned on the same surface, and the plate part 33 has a form and dimensions which can cover an opening 116. In this damper 30, the support parts 31, and 31, and the plate part 33 are made of synthetic resin, such as, for example, plastic, vinyl, FRP, ABS, and so on, and the hinge parts 32, and 32 are formed to be thin as parts of the support parts 31, and 31, and the plate part 33. In this damper 30, the plate part 33 is made to be able to rotate around the hinge parts 32, and 32. That is to say, the damper 30 is made to be able to open and close the opening 116 by the plate part 33 which moves in the direction apart from the opening 116 (refer to the alternate long and two short dash lines in FIG. 3 and FIG. 4).

The fixing means 90 includes engagement portions 91 provided at the support parts 31, and mounting holes 92 which the engagement portions 91 provided at the above-described support stand 23, can be pressed into. The engagement portion 91 is made to be a sagittal form, and is formed at the support part 31 as a part of it with a pair of guide fragments 93, and 93 which are adjacent to the engagement portion 91 with a slit between them. Meanwhile, a mounting hole 92 is formed to be a virtually T-shaped form in a plan which protrudes in the direction of the thickness, and is formed in a rising portion 94 which rises from the top surface 23A of the support stand 23 in a virtually L-shaped form in a plan as a part of it. A pair of the mounting holes 92 is provided at positions which face each other and hold a holding means 60 between them.

In this fixing means 90, when the engagement portion 91, with the guide fragments 93, and 93, is pressed into the mounting hole 92, as the engagement portion 91 is curved against the support part 31, a forward end portion of the engagement portion 91 is engaged in an opening end portion 92A (refer to FIG. 4) of the mounting hole 92, and accordingly, the support part 31 is fixed so that it is not pulled out of the mounting hole 92. Then, the damper 30 has a relative position to the base holder 20 fixed by a stopper 31A (refer to FIG. 4), which is provided at the support part 31, abutting to an opening end portion 92B.

Figure 5:
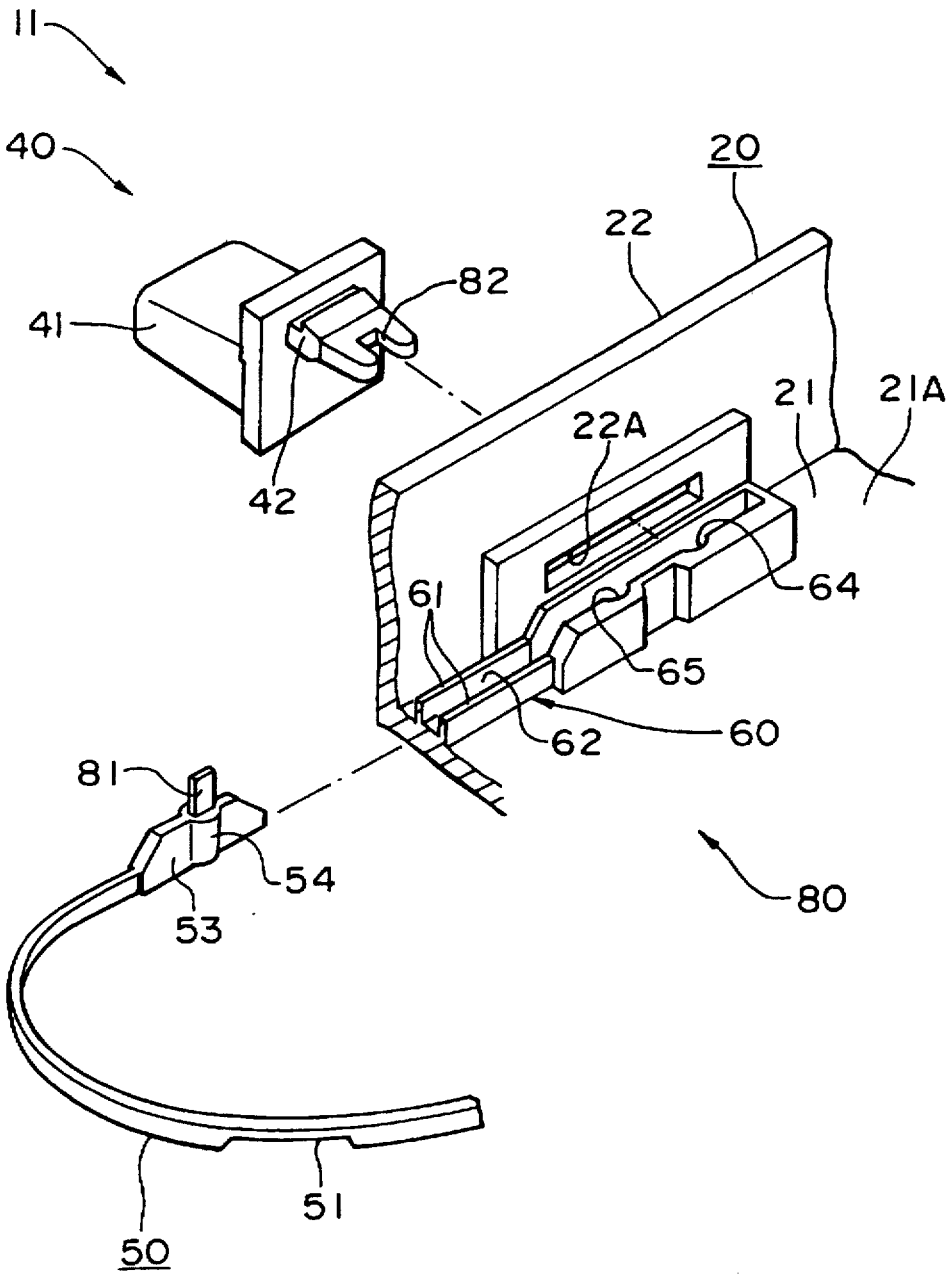
FIG. 5 is an exploded perspective view illustrating a control part.

As FIG. 5 illustrates, the control part 40, which is made to be a slide lever, includes a main body of the lever positioned along an outer surface at the wall portion 22 of the base holder 20, and an insertion fragment 42 which is inserted through to an inner surface side at the wall part 22 of the base holder 20, and connected to the main body of the lever 41. The main body of the lever 41 is appropriately formed in such an excellent form from a human engineering point of view that an operator of the air conditioner 10 can easily conduct the sliding operation of the base holder 20. The insertion fragment 42, which is made to be a virtually sagittal form, is engaged so as to be able to slide along in the direction the slide hole 22A continues, and so as to be unable to be pulled out of the slide hole 22A, when pressed into a rectangular slide hole 22A which is formed at the wall portion 22. Accordingly, in this control part 40, the main body of the lever 41 and the insertion fragment 42 mechanically is displaced in the direction along the wall portion 22.

Returning to FIG. 2, the connection member 50 which is connected to the damper 30 and the control part 40 is made to be a long form which is positioned on the surface 21A of the main body of the base holder 21, on the top surface 23A of the support stand 23 parallel to the surface 21A of the main body of the base holder, and on a slanting surface 24 which is connected to the surface 21A of the main body of the base holder 21 and the top surface 23A of the support stand 23 at the predetermined angles. In this connection member 50, the side of one end is positioned along in the direction in which the damper 30 moves, and the side of the other end is positioned along in the direction in which the control part 40 is displaced, by being curvedly positioned to the surface 21A of the main body of the base holder 21 in a virtually S-shaped form in a plan. This connection member 50, a sectional form of which vertically crosses the longitudinal direction is made to be rectangular, is made of synthetic resin such as, for example, plastic, vinyl, FRP, ABS, and so on. Accordingly, this connection member 50 has the elasticity and friction coefficient which the inventor designs and there is less possibility that twisting, plasticity, and so on are generated, by appropriately selecting the material.

Figure 6:
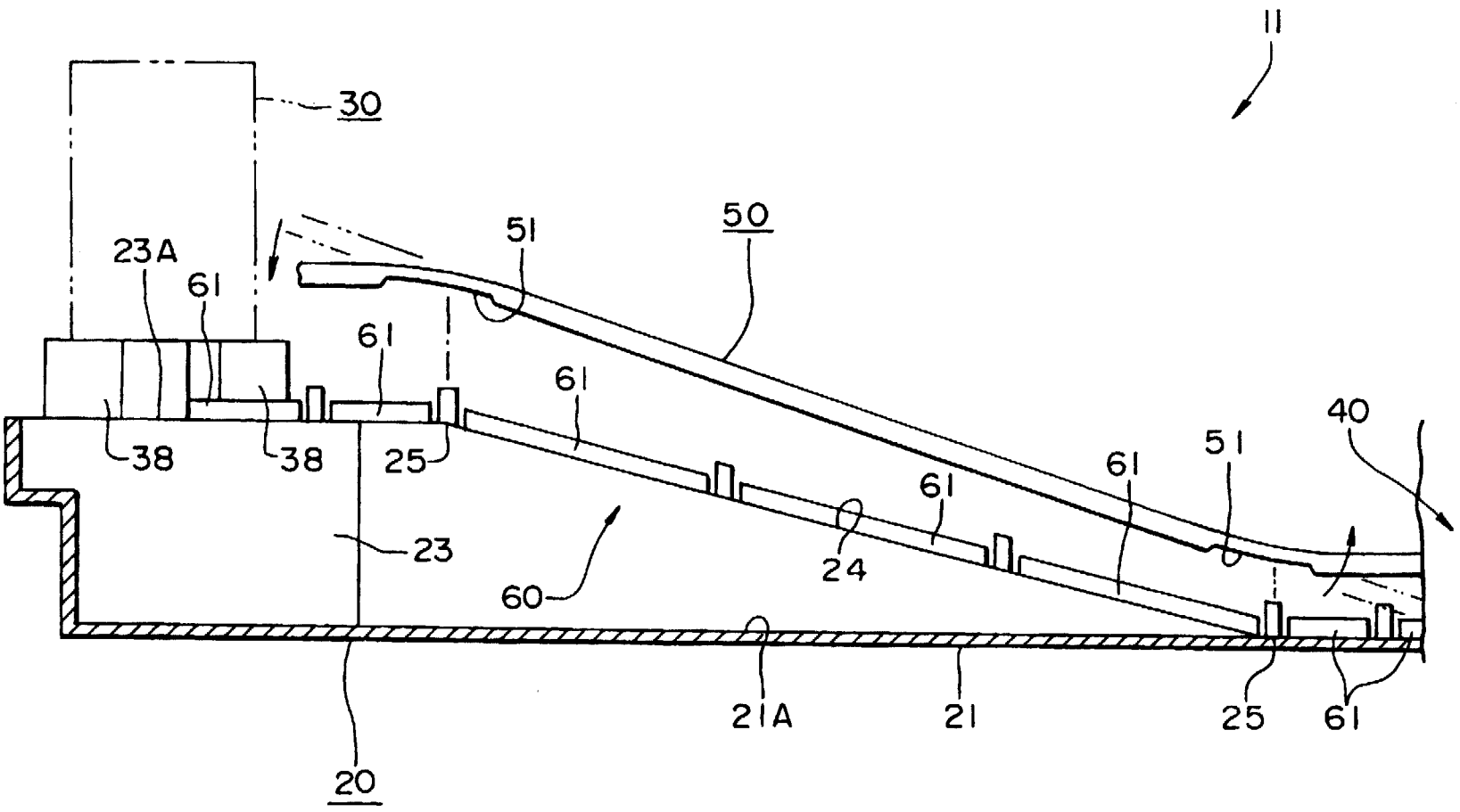
FIG. 6 is a typical sectional view of a damper operating portion illustrating the relative position of recess parts of a connection member and catch portions of a holding means.

As FIG. 6 illustrates, in the connection member 50, recess parts 51 are formed at the position where the connection member 50 crosses connection lines 25 on the surface 21A of the above-described base holder 21, and on the top surface 23A of the support stand, and the slanting surface 24. The recess parts 51 are formed so that hollows are formed at predetermined positions on the surface connecting to the surface 21A of the main body of the base holder 21, the top surface 23A of the support stand 23, and the slanting surface 24 in the connection member 50, by making a part of the section area which vertically crosses the longitudinal direction of the connection member 50. These recess parts 51 have the dimension in the longitudinal direction set more than the movement of the connection member 50 which moves following the displacement of the control part 40, and are positioned so as to always face the connection lines 25, regardless of the relative position of the connection member 50 to the base holder 20.

In this connection member 50, the section areas of the positions at which the recess parts 51 are formed are smaller than those of the other positions, and so the mechanical strength of the positions become less than the other positions. That is to say, in the connection member 50, the portions at which the recess parts 51 are formed are easily bent (refer to the arrow in the drawing), have less possibility of lifting from the connection line 25, when the connection part 50 is positioned along the surface 21A of the main body of the base holder 21, the top surface 23A of the support stand 23, and the slanting surface 24.

Figure 7:
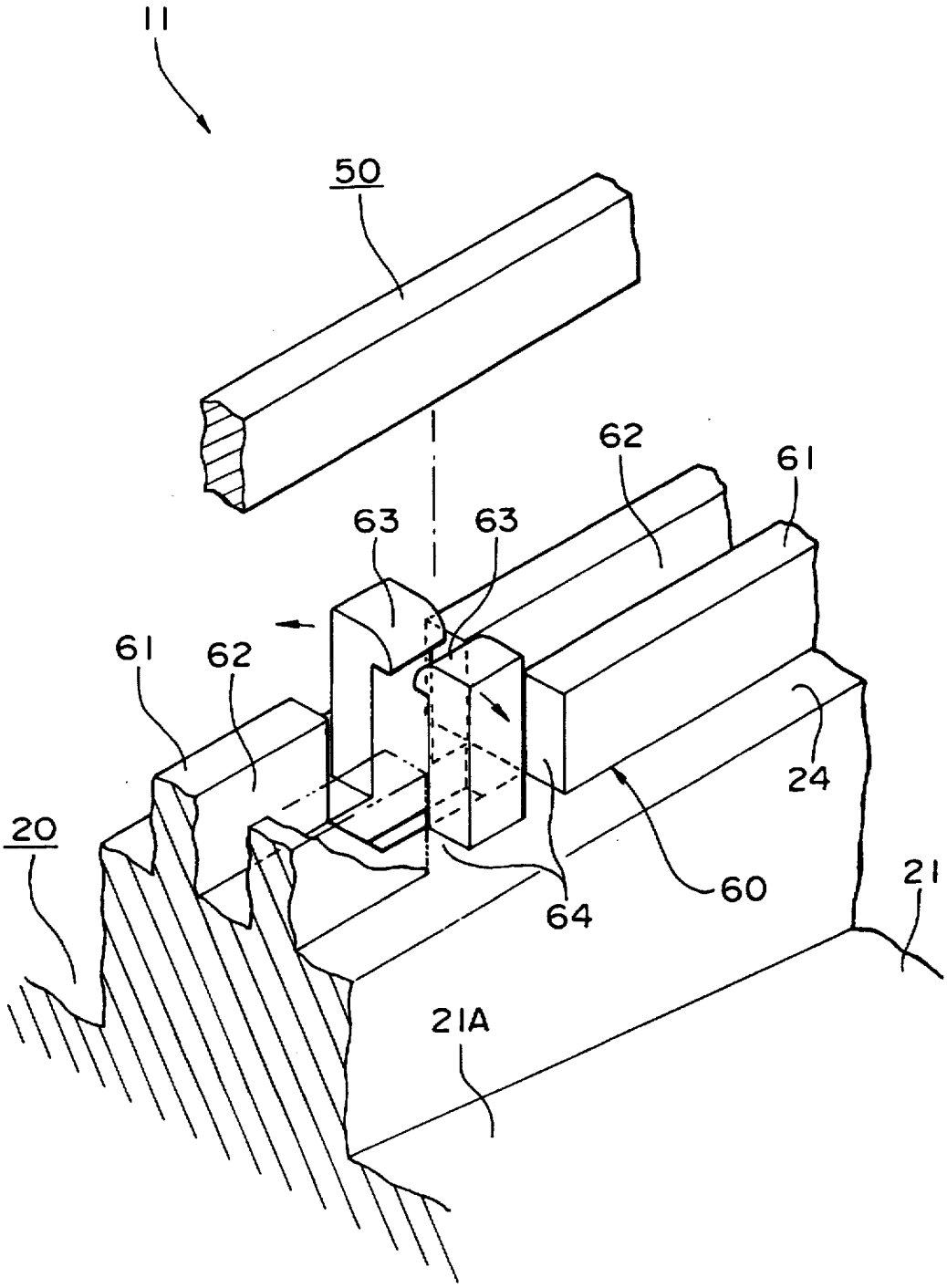
FIG. 7 is an enlarged perspective view illustrating a holding means and catch portions.

As FIG. 7 illustrates, the holding means 60, wherein the holding part 61 within which the connection member 50 is held is projectingly provided in the direction apart from the base holder 20, is made to guide the connection member 50. The holding part 61 is made to be a virtually C-shaped sectional form in which the connection member 50 is removably disposed, and the sectional opening 62 is positioned in the direction apart from the base holder 20. The holding part 61 extends along the connection member 50, and has the predetermined length which continues between the damper 30 and the control part 40 (refer to FIG. 6).

In this holding means 60, catch portions 63 are provided at the opening 62 of the holding part 61. The catch portions 63 are made in a form which can engage the surface facing the direction apart from the base holder 20 of the connection member 50, and a pair of the catch portions 63 is provided so as to hold the connection member 50 between them. In the holding means 60, a pair of slits 64, and 64 is formed at positions to have the catch portions 63 between them in the direction along the holding part 61. Accordingly, the catch portions 63 become virtually reverse J-shaped form independent from the holding part 61 which is next to the catch portions 63 by these slits 64, and 64, and the deformation by bending (refer to the arrows in the drawing) to the base holder 20 has no effect on the holding parts 61 adjacent thereto, when the connection member 50 is pressed into the inside of the holding part 61. A large number of catch portions 63 are provided in the direction in which the holding part 61 continues at the predetermined intervals, and are provided at the position corresponding to the above-described connection line 25 (refer to FIG. 6).

Returning to FIG. 3 and FIG. 4, the connection means 70 for connecting the connection member 50 to the damper 30 includes a pair of pegs 71, and 71 which are formed at the end part in the longitudinal direction of the connection member 50 as a part of it, and a pair of slots 72, and 72 which are formed at the damper 30 as a part of it. The pegs 71, and 71 are made to be virtually cylindrical forms, and are formed to project in the direction which vertically crosses the longitudinal direction of the connection member 50 from a support fragment 52 of a virtual triangle form provided at the end part of the longitudinal direction of the connection member 50. The slots 72, and 72 are made to be grooves of virtually U-shaped forms corresponding to the diameters of the pegs 71, and are respectively formed at a pair of arm portions 34, and 34 which are extended parallel to the support parts 31, and 31 from the plate part 33 of the damper 30. The slot 72 continues along the longitudinal direction of the arm portion 34 for a predetermined length, and has a pair of sliding contact surfaces which are parallel to each other, holding the peg 71 in the diameter direction.

In this connection means 70, when the damper 30 is supported at the support stand 23 of the base holder 20 by the fixing means 90, in the state that the connection member 50 is guided by the holding means 60, the pegs 71, and 71 are inserted into the slots 72, and 72. The connection means 70 makes the plate part 33 rotate around the hinge parts 32, and 32 of the damper 30, by the pegs 71 moving along the slots 72, when the connection member 50 moves, following the mechanical displacement of the control part 40 (refer to the arrows in FIG. 3, and FIG. 4).

The pegs 71 of the connection means 70 project in the direction which crosses the longitudinal direction of the connection member 50. The side of one end of the connection member 50 is positioned along in the direction in which the damper 30 moves. That is to say, the pegs 71 of the connection means 70 project in the direction which crosses the direction in which the damper 30 moves. Accordingly, in the connection means 70, the state that the pegs 71 are inserted into the slots 72 is maintained, even when the relative position of the pegs 71 and the slots 72 are changed by the movement of the connection member 50 following the control part 40, and therefore there is no possibility that the pegs 71 and the slots 72 are detached from each other, even when they are not fixed to each other.

Meanwhile, proceeding to FIG. 5, the connection means 80 for connecting the connection member 50 to the control part 40 includes a peg 81 formed at the end part of the longitudinal direction of the connection member 50 as a part of it, and a slot 82 formed at the insertion fragment 42 of the control part 40 as a part of it. The peg 81 is made to be a virtual rectangular plate form, and is formed so as to project in the direction which vertically crosses the longitudinal direction of the connection member 50 from a support fragment 53 of a virtually trapezoid form provided at the end part of the longitudinal direction of the connection member 50. The slot 82 is made to be a notch of virtually U-shaped form corresponding to the width of the peg 81, and is formed at the forward end of the insertion fragment 42.

In this connection means 80, when the insertion fragment 42 of the control part 40 is pressed into the slide hole 22A on the wall portion 22 in the state that the connection member 50 is guided by the holding means 60, the peg 81 is held in the slot 82. By the connection means 80, the connection member 50 is moved, following the control part 40, when the control part 40 is mechanically displaced relative to the base holder 20.

The peg 81 of the connection means 80 projects in the direction which vertically crosses the longitudinal direction of the connection member 50. The side of the other end of the connection member 50 is positioned along in the direction in which the control part 40 slides. That is to say, the peg 81 of the connection means 80 projects in the direction which vertically crosses the direction in which the control part 40 is displaced. Accordingly, in the connection means 80, the state that the peg 81 is inserted into the slot 82 is maintained, as long as the control part 40 is held in the base holder 20, and therefore there is no possibility that the peg 81 and the slot 82 are detached from each other, even when they are not fixed to each other.

In this drawing, in a holding part 61, bending concave parts 64, and 65 are formed at the position corresponding to the insertion fragment 42, and the slot 82. The bending concave parts 64, and 65 are made to fix the relative position of the control part 40 to the base holder 20, by engaging it into a bending convex part 54 provided at the support fragment 53, and are positioned, considering the form, dimension, relative position, and so on of the damper, the control part 40, and the connection member 50. In concrete, the bending concave part 64 is formed at the position which makes the damper 30 completely open the opening 116 (not illustrated in the drawing), and the bending concave part 65 is formed at the position which makes the damper 30 completely close the opening 116.

Next, the procedure to assemble the damper operating portion 11 in the air conditioner of the present embodiment is described.

First, as FIG. 7 illustrates, put the connection member 50 into the inside of the holding part 61. This operation is completed by positioning the same surface as the surface where each recess part 51 in the connection member 50 is formed upwardly, and then by pressing the connection member 50 to the inside of the holding part 61.

Then, move the connection member 50 along the holding means 60, confirm that the side of one end in the longitudinal direction is positioned between the rising parts 94, and 94 which arrange the fixing means 90 (refer to FIG. 3 and FIG. 4), and confirm that the bending convex part 54 provided at the side of the other end in the longitudinal direction is engaged in the bending concave part 64 formed at the holding part 61 (refer to FIG. 5).

Then, conduct the operation to support the damper 30 at the base holder 20, and the operation to incorporate the control part 40 in the base holder 20. Either of these operations may be conducted first.

As FIG. 3, and FIG. 4 illustrate, the operation to support the damper 30 at the base holder 20 is completed by pressing the engagement parts 91, and 91 which are formed at the damper 30 to be a part of it into the mounting holes 92, and 92 which are formed at the base holder 20 as a part of it, while monitoring to confirm that the pegs 71, and 71 which are formed at the connection member 50 as a part of it are inserted into the slots 72, and 72 which are formed at the damper 30 as a part of it. Meanwhile, the operation to incorporate the control part 40 in the base holder 20 is completed by pressing the insertion fragment 42 into the slide hole 22A on the wall part 22, while monitoring the peg 81 is inserted into the slot 82, as FIG. 5 illustrates.

The damper operating portion 11 assembled in this way is incorporated in the main body 101 of the air conditioner 10, as FIG. 1 illustrates. When users of the air conditioner 10 operate the control part 40, the opening 116 of the partition panel 108 is opened and closed, so that the flow amount, temperature, and so on of the attempered air sent from a blast port 105 is appropriately adjusted.

By the above-described air conditioner 10 of the present embodiment, wherein the connection member 50 is guided by the holding means 60, the parts which have conventionally fixed the connection member 50 at the base holder 20 are not required, therefore the number of the parts arranging the damper operating portion 11 is reduced, and the assembly process of the damper operating portion 11 is simplified. The connection member 50, which is protected by the holding part 61 which holds the connection member 50 within it, does not require the member which has been conventionally adopted, and has a double structure consisting of a wire and an outer tube, and therefore the number of the parts arranging the damper operating portion 11 can be further reduced.

Further, the connection means 70, and 80 project in the directions where the pegs 71, and 81 respectively and vertically cross the direction in which the damper 30 moves, and the direction in which the control part 40 changes the position, so that the state that the pegs 71, and 81 are inserted into the slots 72, and 82 can always be maintained, regardless of the movement of the damper 30, and the displacement of the control part 40, even when the pegs 71, and 81 are not fixed to the slots 72, and 82. That is to say, the operation to connect the connection member 50 to the damper 30, or the control part 40 is completed by conducting a simple operation to insert the pegs 71, and 81 into the slots 72, and 82, and therefore the assembly process of the damper operating portion is greatly simplified, compared to the prior art.

In the connection means 70, wherein the circumference surface of the pegs 71, which are formed to be virtually cylindrical forms, linearly slide and contact the sliding contact surfaces of the slots 72, the pegs 71 only move along the slots 72, even when the relative position, or the relative angle of the pegs 71 and the slots 72 change, following the movement of the damper 30, so that the state that the pegs 71 are inserted into the slots 72, and the sliding contact resistance can be fixedly maintained.

This connection means 70, wherein the pegs 71 are formed at the connection member 50 as a part of it, and the slots 72 are formed at the damper 30 as a part of it, does not require the pegs 71 and the slots 72 as separate members, so that the number of the parts arranging the damper operating portion 11 can be further reduced.

Meanwhile, the connection member 50, which is made of synthetic resin, can be obtained easily and less expensively, compared to the connection members made of, for example, metal, and wood. If the connection member 50 is appropriately selected as a synthetic resin material, excellent flexibility can be obtained and the surface friction coefficient can be made small, therefore the connection member 50 has less possibility of the friction resistance even if it is bent. The connection member 50, wherein the section form which vertically crosses the longitudinal direction is of rectangular forms, can obtain comparatively much strength against the bending stress and the twisting stress.

In this connection member 50, the recess parts 51 are formed at the positions crossing the connection lines 25, so that the above-described positions are easily bent. Accordingly, the connection member 50 does not lift from the base holder 20, even when the connection member 50 is positioned along the surface of the main body of the base holder 21, the slanting surface 24, and the top surface 23A of the support stand 23 which are connected at predetermined angles.

The recess parts 51 have reduced mechanical strength by making the section area which vertically crosses the longitudinal direction of the connection member 50 small and narrow, so that the position of the recess parts 51 are easily further bent. Especially in this connection member 50, wherein the recess parts 51 are formed to face the connection lines 25, the connection member 50 and the connection lines 25 do not contact each other, so that the connection member has far less possibility of lifting from the base holder 20.

Meanwhile, the holding means 60, which is projectingly provided in the direction apart from the base holder 20, can be positioned, regardless of the thickness of the base holder. This holding means 60 has the holding parts 61 of virtually C-shaped sectional forms, so that the connection member 50 can be easily attached and detached, and the assembly process of the damper operating portion 11 can be further simplified. Especially, in the holding parts 61, the section opening 62 is positioned in the direction apart from the base holder 20, so that workers assembling the damper operating portion 11 can watch and confirm the mutual conditions of the connection member 50, and the holding means 60, and therefore there is no possibility of the assembly and so on of the damper operating portion 11 being wrong.

Further, the holding parts 61, which continues along the connection member 50 for predetermined lengths, can surely hold the connection member 50. Accordingly, even when the movement resistance of, for example, the damper 30 is large, there is less possibility that the connection member 50 will deviate from the holding part 61, following the displacement of the control part 40, and therefore there is less possibility of the case in which the opening 116 will not open or close.

The holding means 60, wherein the catch portions 63 are provided at the sectional opening 62 of the holding part 61, has a far less possibility of the connection member 50 deviating from the holding part 61. The catch portions 63 are also provided at the positions corresponding to the connection lines 25, so that the connection member 50 does not lift from the connection lines 25.

In the holding part 61, wherein the slits 64 are formed at the positions holding the catch portions 63 between them, one part of the holding part 61 supporting the catch portions 63 is separated from the other parts and made to be able to deform. Accordingly, the holding means 60 has less possibility of plasticity, breakage, and so on being generated in the entire body of the holding part 61, following the attachment and detachment of the connection member 50.

Meanwhile, the damper 30 has the arrangement where the plate part 33 is connected to the support parts 31 fixed at the base holder 20 by the hinge parts 32. That is to say, the damper 30 has the simple arrangement, so that the manufacturing cost is comparatively low, and is widely used for openings with different forms and dimensions by appropriately selecting and adopting the plate part. Especially, the damper 30, wherein the hinge parts 32 which are formed to be thin are formed to be one body with the support parts 31 and the plate part 33, does not require separate hinge members, end therefore the number of the parts arranging the damper operating portion 11 can be further reduced.

Further, the fixing means 90 which supports the damper 30 at the base holder 20 has the arrangement where the engagement parts 91 of sagittal forms are pressed into the mounting holes 92, so that the assembly process of the damper operating portion 11 can be further simplified, compared to the operation for conducting, for example, the bolt fixation and so on. Especially, the fixing means 90, wherein the engagement parts 91 are formed at the damper as a part of it, and the engagement parts 91 are formed at the base holder 20 as a part of it, does not require preparing separate members, so that the number of the parts arranging the damper operating portion 11 can be further reduced.

Meanwhile, the control part 40, which is a slide lever, can make the arrangement simple and compact, compared to, for example, a knob of a push/pull operation, a button of a push/push cancel operation, a handle for rotating the rotation shaft and so on. Accordingly, the number of the parts arranging the damper operating portion 11 can be further reduced, and the damper operating portion 11 can be made compact, and light.

The assembly of the control part 40 is completed by conducting an extremely simple operation of pressing the insertion fragment 42 of the virtually sagittal form into the slide hole 22A on the wall part 22, therefore the number of the parts arranging the damper operating portion 11 can be reduced, and the assembly process of the damper operating portion 11 can be further simplified.

It is to be understood that the present invention is not intended to be limited to the above-described embodiments, and various changes, modifications, and so on may be included in the scope of the present invention.

Figure 8A:
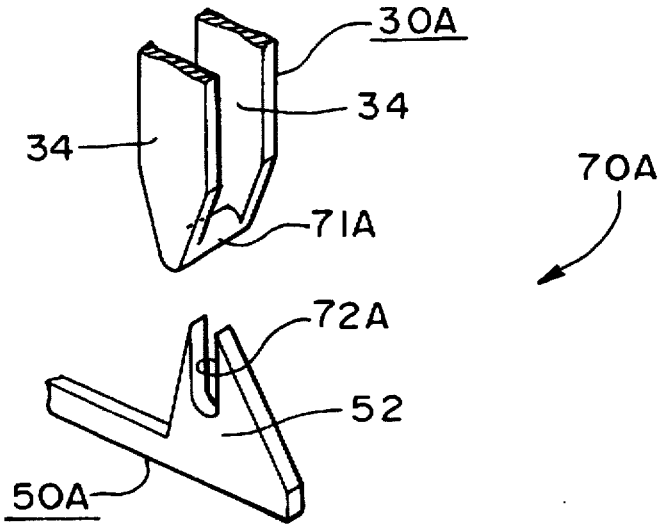
FIG. 8 (A), and FIG. 8 (B) are typical sectional views illustrating modified embodiments of a connection means.
Figure 8B:
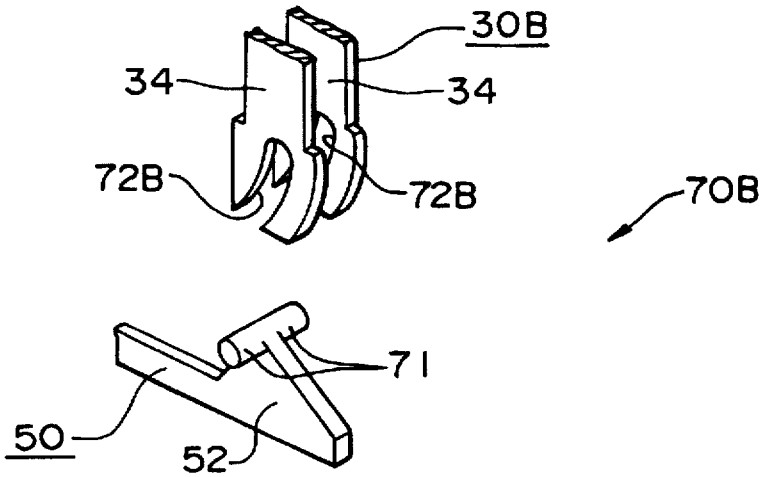

For example, as the connection means for connecting the damper and the connection member, the arrangement where a convex part or peg 71A is inserted into a concave part or slot 72A, with the concave part 72A of a virtually U-shaped form being provided at a connection member 50A and with the convex part 71A of a virtually cylindrical form being provided between arm parts 34, and 34 of a damper 30A may be adopted, as a connection means 70A illustrated in FIG. 8 (A). As the connection means for connecting the damper and the connection member, the arrangement where concave parts 72B, and 72B are bent, as a connection means 70B illustrated in FIG. 8 (B), may be adopted. By this connection means 70B, when the connection member 50 is moved to follow as in the above-described preferable embodiment, the arm parts 34, and 34 move further, compared to those in the above-described embodiment, so that the rotation angle of the plate part to the support part which is not illustrated in the drawing can be made large. That is to say, since the flow amount passing through the opening can be made large, a drastic adjustment of the flow amount, or adjustment of the temperature in the air conditioner can be made.

Figure 9A:
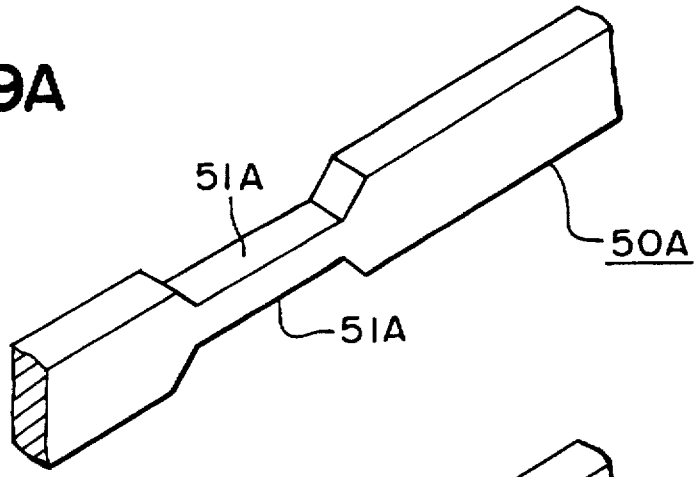
FIG. 9 (A), FIG. 9 (B), and FIG. 9 (C) are typical sectional views illustrating modified embodiments of a recess part.
Figure 9B:
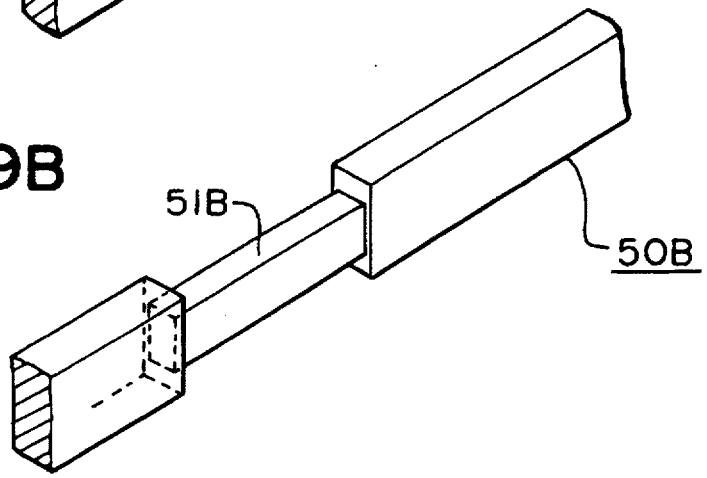
Figure 9C:
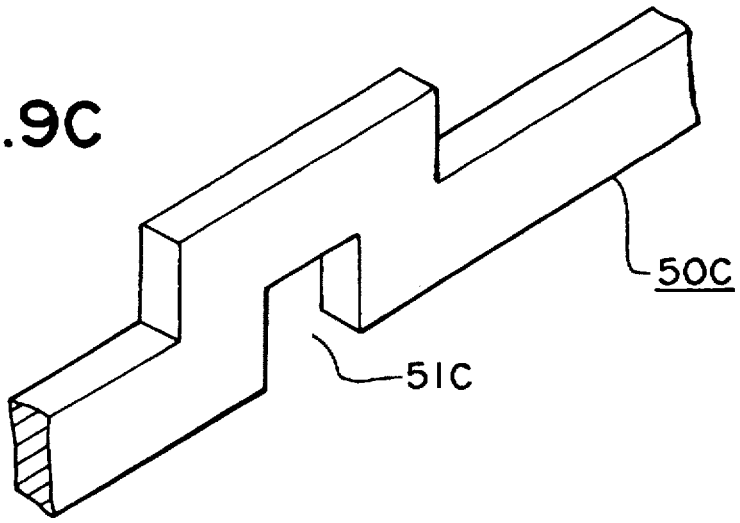

Further, as the recess parts formed at the connection member, a recess part 51A illustrated in FIG. 9 (A), a recess part 51B illustrated in FIG. 9 (B), and a recess part 51C illustrated in FIG. 9 (C) may be selected and adopted. That is to say, the recess parts 51A illustrated in FIG. 9A are formed on the surfaces facing in the direction apart from each other in the connection member 50A which is formed to be virtually rectangular sectional form. By this connection member 50A, wherein the section area of the recess part 51A is small, compared to that of the above-described embodiment, this position is bent more easily. The recess part 51B illustrated in FIG. 9B is formed to surround the circumference surface in a connection member 50B which is formed to be a virtually rectangular sectional form. This connection member 50B, wherein the portion at which the recess part 51B is formed can be bent in a two-dimensional direction, can be positioned along a plurality of surfaces connected in a three-dimensional direction. The recess part 51C illustrated in FIG. 9C is obtained by forming a connection member 50C which is formed to be a virtually rectangular sectional form to be a virtual crank form. By using this connection member 50C, a comparatively large bending angle can be obtained.

Figure 10A:
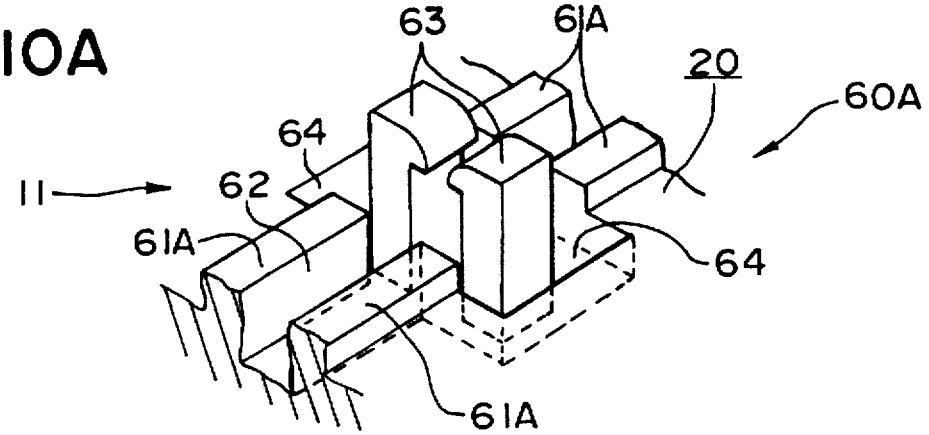
FIG. 10 (A), FIG. 10 (B), and FIG. 10 (C) are perspective views of essential parts illustrating modified embodiments of a holding means.
Figure 10B:
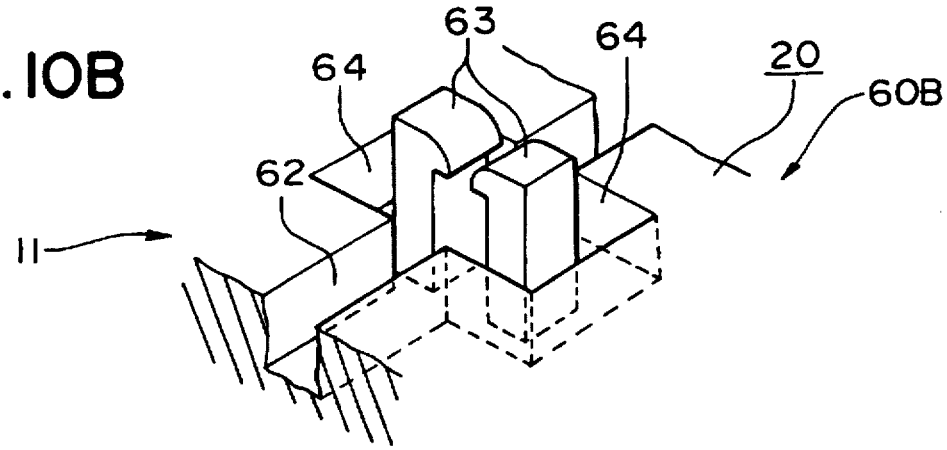
Figure 10C:
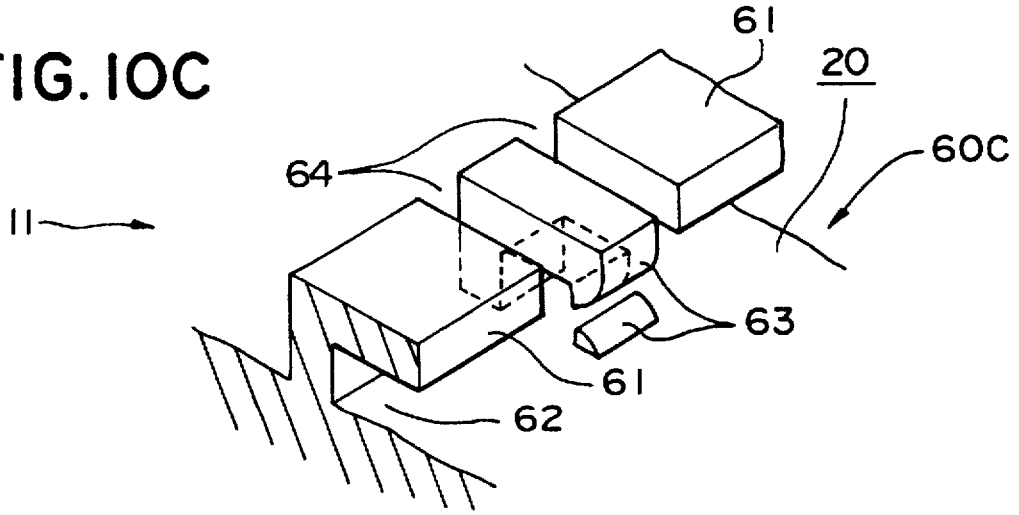

As the holding means, the holding means is not limited to the form described in the above-described embodiment, and a holding means 60A illustrated in FIG. 10 (A), a holding means 60B illustrated in FIG. 10 (B), and a holding means 60C illustrated in FIG. 10 (C) may be selected and adopted. That is to say, in the holding means 60A illustrated in FIG. 10 (A), a holding part 61A is provided so as to sink a little in the thickness direction of the base holder 20, so that more space is saved within the damper operating portion 11, by making the height of the part which is projectingly provided from the surface of the base holder 20 short. In the holding means 60B illustrated in FIG. 10 (B), the thickness of the base holder 20 is made to be the holding part by forming a groove on the surface of the base holder 20, and far more space is saved within the damper operating portion 11. Further, in the holding means 60C illustrated in FIG. 10 (C), a section opening 62 of a holding part 61 is positioned in the direction along the surface of the base holder 20. By this holding means 60C, even when other members, and mechanisms are piled in the thickness direction of the base holder 20, the connection member can be surely guided, without giving influence on the connection member.

Figure 11A:
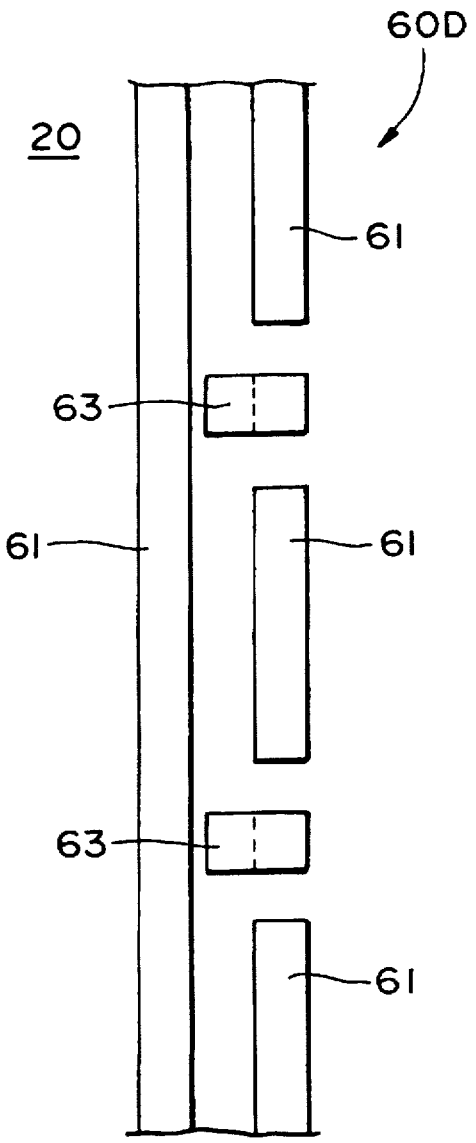
FIG. 11 (A) and FIG. 11 (B) are typical plan views illustrating modified embodiments of catch portions.
Figure 11B:
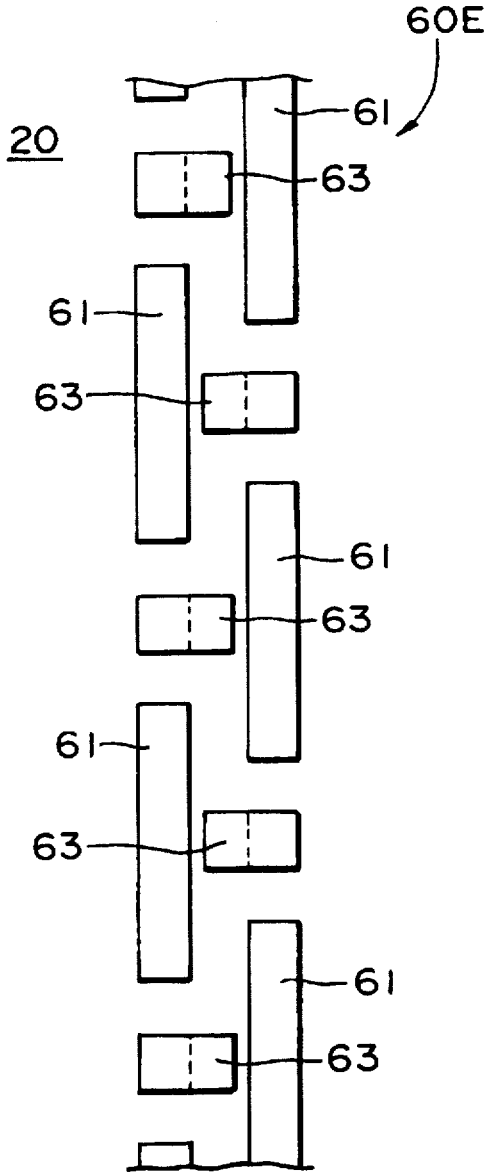

Further, in the above-described embodiment, a pair of catch portions is positioned facing each other art he section opening of the holding part, however, catch portions 63 may be provided at only one of the holding parts 61, and 61 which are parallel to each other, as a holding means 60D illustrated in FIG. 11 (A), or the catch portions 63 may be alternately provided at the holding parts 61, and 61 which are parallel to each other, as a holding means 60E illustrated in FIG. 11 (B).

Figure 12:
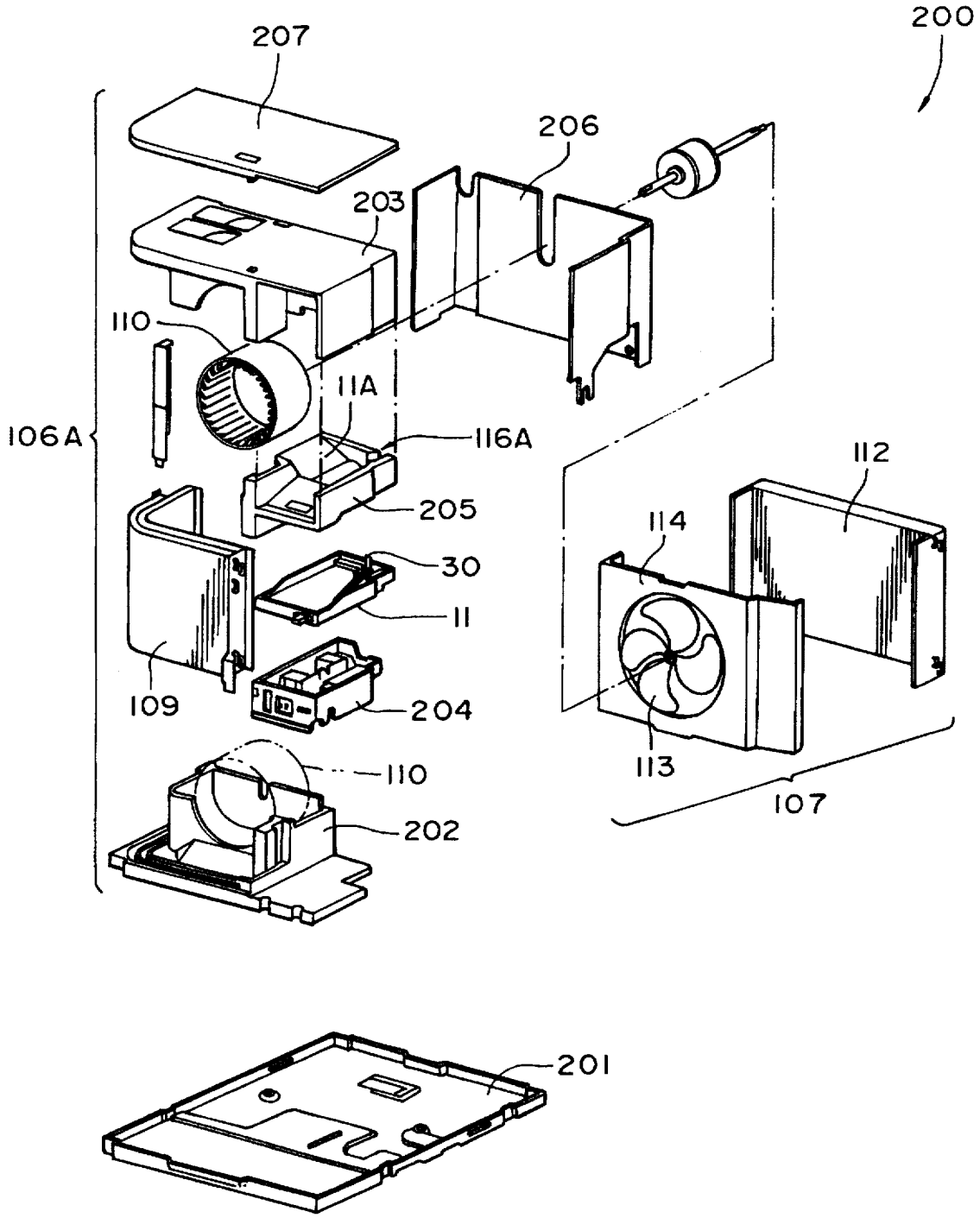
FIG. 12 is an exploded perspective view illustrating a modification of an air conditioner.

As an air conditioner relating to the present invention, the present invention is not intended to be limited to the air conditioner described in the above-described embodiment and an air conditioner 200 as FIG. 12 illustrates is also included in the present invention.

In this air conditioner 200, an indoor heat converter room 106A has a lower part supporting member 202 laid on a main frame 201 of a virtually flat board form and an upper part supporting member 203. This indoor heat converter room 106A is formed by positioning a switch box 204, a damper operating portion 11, and a blast passage forming member 205 in this order on a predetermined position of the lower part supporting member 202, within which an indoor fan 110 is received, and then by positioning the upper part supporting member 203 so as to cover the indoor fan 110 and the blast passage forming member 205.

The blast passage forming member 205 is in a suitable form for forming a blast passage 111A when the upper part supporting member 203 is positioned in a predetermined place, and a damper 30 of the damper operating portion 11 positioned at the bottom of the blast passage forming member 205 can be inserted through the blast passage forming member 205, with a cut portion provided at the position corresponding to the inserted damper 30. Accordingly, in the indoor heat converter room 106A, the blast passage 111A is automatically formed by positioning the lower part supporting member 202, the indoor fan 110, the switch box 204, the damper operating portion 11, the blast passage forming member 205, and the upper part supporting member 203 on the predetermined positions, and an opening 116A formed by the cut portion can be opened and closed by the damper operating portion 11.

In this indoor heat converter room 106A, the lower part supporting member 202, the upper part supporting member 203, and the blast passage forming member 205 are made of, for example, styrene foam, and a cover 207 made of metal is positioned on a top of the upper part supporting member 203, while a wall member 206 made of metal is positioned along the lower part supporting member 202 and the upper part supporting member 203. In the wall member 200, a blanking is performed on the position corresponding to the opening 116A, and attempered air sent along the blast passage 111A can be discharged therefrom.

By the above-described air conditioner 200, in which the indoor heat converter room 106A is formed by positioning the lower part supporting member 202, the indoor fan 110, the switch box 204, the damper operating portion 11, the blast passage forming member 205, and the upper part supporting member 203 in this order, the effects of the easy assembly and of the manufacturing cost reduction can be obtained.

Further, by this air conditioner 200, heat loss can be small when attempered air is sent, since the blast passage 111A is formed by the upper part supporting member 203 and the blast passage forming member 205 which are made of styrene foam.

The others such as materials, forms, dimensions, shapes, numbers, positioning places, and so on of the main body of the air conditioner, the partition panel dividing the inside of the main body, the opening provided on the partition panel, the base holder, the damper, the support parts, the plate part, the hinge parts, the control part, the lever, the insertion fragment, the connection member, the holding means, the convex parts or pegs, the concave parts or slots, the connection lines, the recess parts, the holding part, the sectional opening, the catch portions, the slits, the fixing means, the engagement parts, the mounting holes, and so on are optional, and not limited.

What is claimed is:

1. An air conditioner, comprising:

a main body in a box form including an indoor heat converter room, an outdoor heat converter room, and a partition panel for dividing the indoor and outdoor heat converter rooms and having an opening therein, a base holder situated in the main body under the opening and being made of a synthetic resin, a damper supported on the base holder for covering the opening of the partition panel, said damper being moved relative to the opening of the partition panel for opening and closing the same and having first connecting means integrally formed with the damper, a control part movably disposed on the base holder and having second connecting means integrally formed with the control part, an elongated connection member for connecting the control part and the damper to move the damper by operating the control part, said connection member being made of a synthetic resin and having at both ends third and fourth connecting means integrally formed with the connecting member, said first and third engaging means being formed of a peg and a slot engaging together and said second and fourth connecting means being formed of a peg and a slot engaging together, and holding means made of a synthetic resin and integrally formed with the base holder, said holding means guiding the connection member therein and having a holding part with a substantially C-shaped cross section for holding the connection member therein so that the damper and the control part can be easily assembled together with the connection member through the holding means.

2. The air conditioner according to claim 1, wherein a sectional form which vertically crosses a longitudinal direction of the above-described connection member is of rectangular forms.

3. An air conditioner according to claim 1, wherein the above-described connection member is positioned along a plurality of plane surfaces which are connected at predetermined angles, and recesses are formed at a position where the connection member crosses a connection line of each of the above-described plane surfaces.

4. An air conditioner according to claim 3, wherein the above-described recesses are formed by making section areas which vertically cross the above-described connection member small, and narrow.

5. An air conditioner according to claim 4, wherein the above-described stair parts are formed to face the above-described connection lines.

6. An air conditioner according to claim 1, wherein the above-described holding means is projectingly provided in the direction apart from the above-described base holder.

7. An air conditioner according to claim 1, wherein the above-described holding part is positioned with a section opening facing a direction apart from the above-described base holder.

8. An air conditioner according to claim 1, wherein the above-described holding part continues along the above-described connection member for predetermined lengths.

9. An air conditioner according to claim 1, wherein catch portions for holding the above-described connecting member within said holding means are provided at an opening of the above-described holding part.

10. An air conditioner according to claim 9, wherein the above-described holding part is formed along a plurality of plane surfaces connected at predetermined angles, and the above-described catch portions are provided at the portions of the connection line of each of the above-described plane surfaces.

11. An air conditioner according to claim 10, wherein slits are formed at the portions which hold the above-described catch portions in the direction along the direction where the above-described holding part continues.

12. An air conditioner according to claim 1, wherein the above-described damper has support parts which are fixed at the above-described base holder, and a plate part which is connected to the above-described support parts, and the above-described plate part rotates around the above-described support parts with hinge parts between them.

13. An air conditioner according to claim 12, wherein the above-described hinge parts are thin hinges which are formed integrally with the above-described support parts and the above-described plate part.

14. An air conditioner according to claim 12, wherein the above-described damper is supported at the above-describe base holder by fixing means which presses engagement parts of sagittal forms into mounting holes, and one of the above-described engagement part and the above-described mounting hole is formed at the above-described base holder as a part of it, while the other of the above-described engagement part and the above-described mounting hole is formed at the above-described support part as a part of it.

15. An air conditioner according to claim 1, wherein the control part is a slide lever having a main body positioned along an outer surface of the base holder, and an insertion fragment connected to the main body and having a sagittal form inserted into an inner surface side of the base holder.

* * * * *